US008554106B2

(12) United States Patent
Mukai

(10) Patent No.: US 8,554,106 B2
(45) Date of Patent: Oct. 8, 2013

(54) DEVELOPING DEVICE HAVING MAGNETIC SEALING MEMBER AND IMAGE FORMING APPARATUS INCLUDING THE SAME

(75) Inventor: Kenichi Mukai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 699 days.

(21) Appl. No.: 12/497,215

(22) Filed: Jul. 2, 2009

(65) Prior Publication Data

US 2010/0080608 A1 Apr. 1, 2010

(30) Foreign Application Priority Data

Sep. 29, 2008 (JP) ..... 2008-251090

(51) Int. Cl.
*G03G 15/08* (2006.01)

(52) U.S. Cl.
USPC ..... 399/104; 399/284

(58) Field of Classification Search
USPC ..... 399/102–104, 274, 284
See application file for complete search history.

(56) References Cited

U.S. PATENT DOCUMENTS 5,610,697 A * 3/1997 Arai
2004/0218945 A1 11/2004 Yokokawa
2005/0244185 A1* 11/2005 Jeon ..... 399/103
2006/0198655 A1* 9/2006 Kotera et al. ..... 399/104
2006/0216072 A1* 9/2006 Leemhuis et al. ..... 399/284

FOREIGN PATENT DOCUMENTS

JP 61185772 A * 8/1986
JP 61223868 A * 10/1986
JP 02-025869 1/1990
JP 06011958 A * 1/1994
JP 08-202149 8/1996
JP 08-202153 8/1996
JP 2004-170748 6/2004
JP 2007199584 A * 8/2007

* cited by examiner

*Primary Examiner* — Walter L Lindsay, Jr.
*Assistant Examiner* — Milton Gonzalez
(74) *Attorney, Agent, or Firm* — Frommer Lawrence & Haug LLP

(57) ABSTRACT

An embodiment of a developing device may include a housing, magnetic developer, and a developer bearing member. In some embodiments, the developer bearing member may include a magnet member. The magnet member may allow the developer to remain in the housing. A developer regulating member may be positioned proximate the developer bearing member and have one or more cut portions. In some embodiments, the cut portions may be positioned at each end of the developer regulating member in a surface facing the developer bearing member. The developer regulating member may regulate an amount of the developer held on the developer bearing member. A magnetic sealing member may extend along an outer peripheral surface of the developer bearing member at each end and may be positioned proximate the cut portion. In some embodiments, a portion of the magnetic sealing member may be positioned within the cut portion.

16 Claims, 10 Drawing Sheets

DEVELOPING DEVICE HAVING MAGNETIC SEALING MEMBER AND IMAGE FORMING APPARATUS INCLUDING THE SAME

INCORPORATION BY REFERENCE

This application is based upon and claims the benefit of priority from the corresponding Japanese Patent application No. 2008-251090, filed Sep. 29, 2008, the entire content of which is incorporated herein by reference.

FIELD OF THE INVENTION

The present invention relates to an image forming apparatus, such as a copy machine, a facsimile machine, and a printer, and a developing device included in the image forming apparatus.

BACKGROUND OF THE INVENTION

In general, developer powder is mainly used in an electrophotographic image forming apparatus, such as a copy machine, a printer, and a facsimile machine. An electrostatic latent image may be formed on an image bearing member, such as a photosensitive drum. Developer may be used to coat the image bearing member to form a toner image. The toner image is then transferred onto a recording medium, such as paper. A fixing process may be performed to fix the image to the recording medium.

Developer can be broadly classified into a multi-component developer, a two-component developer may include toner and carrier, and a single-component developer may include magnetic toner. A developer regulating member such as a regulating blade, is provided to promote frictional electrification of the developer on a developer bearing member. The developer regulating member may be formed only of a magnetic member. Alternatively, the developer regulating member may include a non-magnetic member as a base member and a magnetic member disposed in an area (e.g., developer regulating area) where the magnetic member faces the developer bearing member.

In a developing device including the above-described developer regulating member, a part of the developer supplied to the developer regulating area passes through the developer regulating member and forms a developer layer on the developer bearing member as the developer bearing member rotates. However, most of the developer supplied to the developer regulating area is blocked by the developer regulating member and is returned to the inside of the developing device. At this time, the developer blocked by the developer regulating member, tends to move toward the ends of the developer bearing member and the developer regulating member in the longitudinal direction thereof. Therefore, it is necessary to prevent the developer from leaking from the developing device at the ends of the developer bearing member and the developer regulating member.

Accordingly, a method for inhibiting leakage of the developer by providing a magnetic sealing member at each end of the developing device in the longitudinal direction thereof has been proposed. According to this method, the leakage of the developer is prevented by using a magnetic brush formed between the magnetic sealing member and the developer bearing member due to a magnetic field between a magnet poles disposed in the developer bearing member and the magnetic sealing member.

The leakage of developer has been prevented using only a magnetic sealing member. As is shown in FIG. 1, depicting a developing device, a magnetic sealing member 101 is fixed to an inner surface of a housing of the developing device at each end prior to use. Thus, the structure is designed such that a gap G2 is provided between the magnetic sealing member 101 and a developer regulating member 104, so that the magnetic sealing member 101 does not interfere with the developer regulating member 104 in the process of attaching the developer regulating member 104. However, in this structure, the direction in which the developer moves from a central area of the developer bearing member to the end thereof (direction shown by the arrow B) coincides with the direction in which the gap G2 extends. Therefore, even if the gap G2 is filled with a magnetic brush formed between the magnetic sealing member 101 and the developer bearing member, the developer easily leaks through the gap G2.

The leakage of the toner at the ends of the developer bearing member can also be prevented by placing a spacer which fills a gap between a developing roller and an end sealing member at each end of the developer bearing member. Therefore, also in the structure including the magnetic sealing member, an auxiliary sealing member (spacer) made of sponge-like elastic body, nonwoven fabric, etc., may be additionally used to prevent the leakage of the developer through a space between an end face of the developer regulating member and a contact surface of the magnetic sealing member. Such a structure is shown in FIG. 2.

Referring to FIG. 2, a magnetic sealing member 101 is positioned upstream of a position where a developer bearing member 102 and a developer regulating member 104 face each other in a rotational direction of the developer bearing member 102 (direction shown by the arrow A). A magnet member 103 having a plurality of magnet poles is disposed in the developer bearing member 102. An auxiliary sealing member 105 made of, for example, sponge, is wound around the developer regulating member 104. An end portion of the magnetic sealing member 101 in the longitudinal direction thereof is in contact with the auxiliary sealing member 105, so that the leakage of the developer through the gap between the magnetic sealing member 101 and the developer regulating member 104 is prevented.

As shown in FIG. 3, an auxiliary sealing member 105 will be attached at a position displaced toward the inside of the developing device (toward the front in FIG. 3). In such a case, the developer which moves along the longitudinal direction of the developer bearing member 102 in the direction shown by the arrow B from the central area of the developer bearing member 102 toward the end thereof is blocked by the magnetic sealing member 101, and the developer which flows downstream in the rotational direction of the developer bearing member 102 (direction shown by the arrow A) due to the rotation of the developer bearing member 102 is blocked by the auxiliary sealing member 105. Therefore, a large load is applied to the auxiliary sealing member 105, and the life of the auxiliary sealing member 105 is considerably reduced. To prevent this, the auxiliary sealing member 105 must be attached with high accuracy. Therefore, the assembly process of the developing device is complex and difficult.

The leakage of the developer may also be prevented by a method using only the magnetic sealing member. In this method, a magnetic member is disposed on a non-contact surface of an elastic developer regulating member, and a magnet is disposed on a portion of a developer container which faces the elastic developer regulating member such that the magnet is spaced from the magnetic member by a predetermined distance, so that a magnetic brush is also formed between the developer container and the elastic developer regulating member.

SUMMARY OF THE INVENTION

An embodiment of a developing device may include, but is not limited to: a housing, a developer bearing member, a developer regulating member, and/or a magnetic sealing member.

In some embodiments, the housing may house a developer. The developer may include, but is not limited to magnetic developer such as a single-component magnetic developer, a two-component developer, for example, a developer including a toner component and magnetic carrier, a multi-component developer or mixtures thereof.

Some housing embodiments may provide support to the developer bearing member. For example, the developer bearing member may be supported by the housing in a manner which allows the developer bearing member to rotate. In an embodiment, a magnet member disposed in the developer bearing member may allow the developer to remain in the developer bearing member.

In some embodiments a developer regulating member may be positioned proximate a developer bearing member. The developer regulating member may be positioned such that it is substantially parallel to the developer bearing member. In an embodiment, a developer regulating member may include a cut portion (e.g., notch) at each end. Some embodiments of the developer regulating member may include one or more cut portions. Cut portions may be positioned in a surface of the developer regulating member proximate the developer bearing member. In some embodiments, the developer regulating member may regulate an amount of developer held on the developer bearing member.

Some embodiments may include a magnetic sealing member which extends along an outer peripheral surface of the developer bearing member at each end of the developer bearing member in the longitudinal direction. Further, the developer bearing member may extend to come in contact with the cut portion from an upstream side in a rotational direction of the developer bearing member.

Other objects and advantages of the present invention will become apparent from the following description of the embodiment.

The above and other objects, features, and advantages of the present invention will be more apparent from the following detailed description of preferred embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
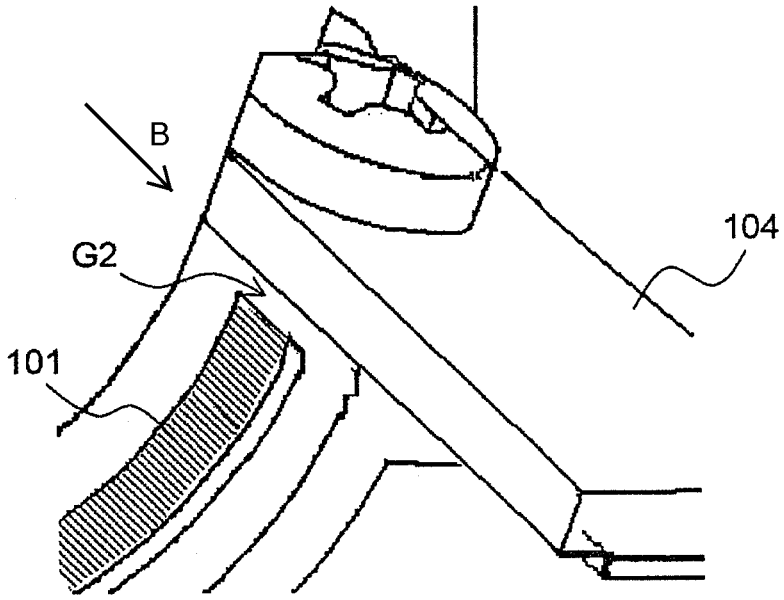
FIG. 1 (PRIOR ART)
FIG. 1 is a sectional perspective view of a section around an end of a developer regulating member included in a developing device according to the prior art from the inside of the developing device.
Figure 2:
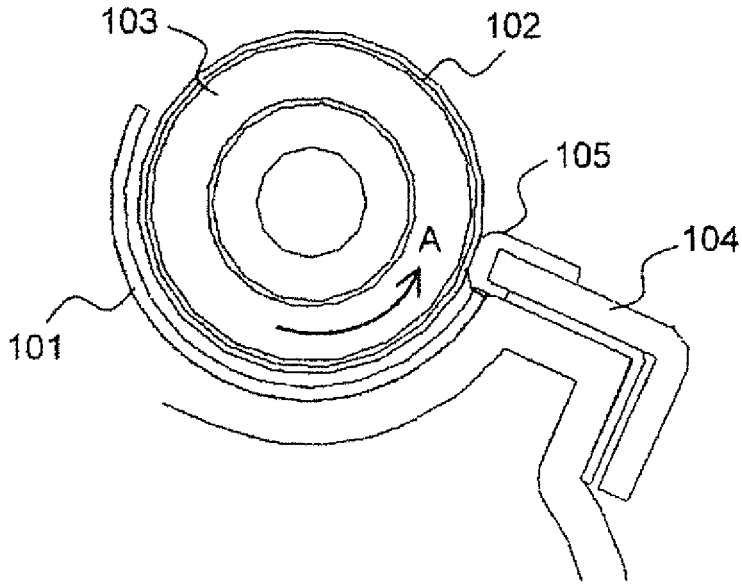
FIG. 2 (PRIOR ART)
FIG. 2 is a sectional view illustrating the structure in which an auxiliary sealing member is disposed in a space between a magnetic sealing member and the developer regulating member in the developing device according to the prior art.
Figure 3:
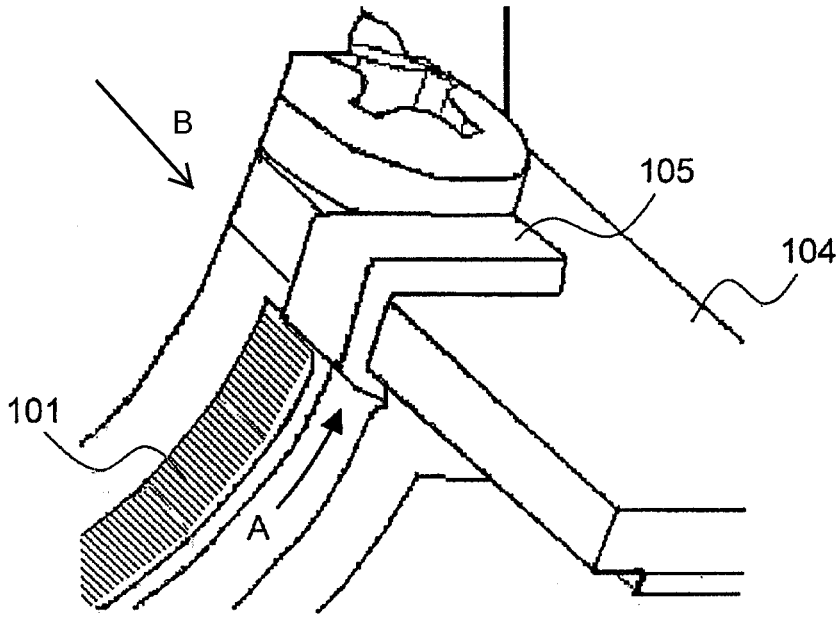
FIG. 3 (PRIOR ART)
FIG. 3 is a sectional perspective view of a section around an end of the developer regulating member shown in FIG. 2 viewed from the inside of the developing device.
Figure 4:
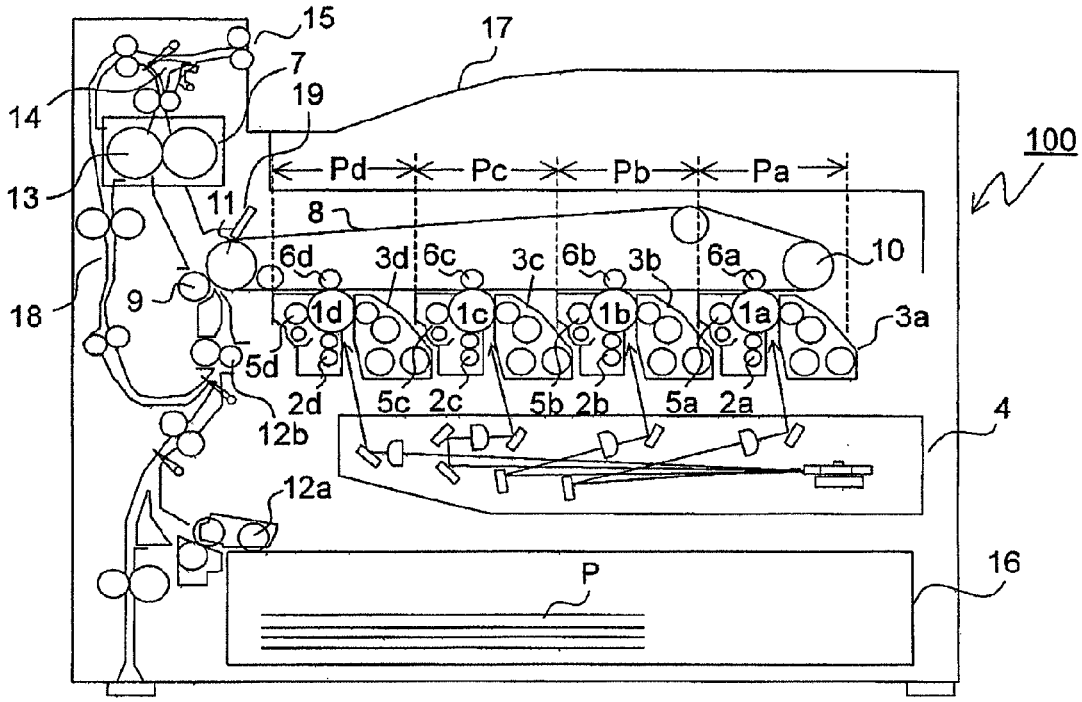
FIG. 4 is a schematic sectional view of an image forming apparatus including a developing device according to the present invention.

An embodiment of the present invention will be described with reference to the drawings. FIG. 4 is a schematic sectional view of an image forming apparatus including a developing unit. In the present embodiment, color image forming apparatus 100 will be described. An image forming apparatus may include tandem operation. For example, an embodiment may include utilizing multiple colors in a color image forming apparatus in succession. Thus, an embodiment of a color image forming apparatus may include one or more image forming sections. In an embodiment, each image forming section may correspond to a different color. For example, an imaging forming apparatus may have multiple image forming sections each corresponding to a different color. These color images may be transferred to a recording medium. Recording media may include, but are not limited to paper, transparencies, labels, transfer sheets and/or any other media known in the art.

As shown in FIG. 4, color image forming apparatus 100 includes four image forming sections Pa, Pb, Pc, and Pd, positioned in order from the upstream side (right side in FIG. 4) in the direction of the conveyance of the recording medium (e.g., a sheet of paper). The image forming sections Pa to Pd may correspond to four different colors (e.g., cyan, magenta, yellow, and black). Thus, utilizing the positioning shown in FIG. 4, the color images may be transferred successively. For example, a cyan image, a magenta image, a yellow image, and a black image may be formed successively on the recording medium. Thus, an image may be formed by performing a charging step, an exposure step, a developing step, and a transfer step. In some embodiments, the order of the color images formed may vary. In addition, the colors utilized may vary.

The image forming sections Pa to Pd include photosensitive drums 1*a*, 1*b*, 1*c*, and 1*d*, respectively, on which visual images (e.g., toner images) of the respective colors may be formed. The toner images formed on the photosensitive drums 1*a* to 1*d* are successively transferred onto intermediate transfer belt 8, which is rotated clockwise in FIG. 4 by a driver (not shown) so as to move through positions adjacent to the image forming sections. Then, the toner images may be simultaneously transferred onto a recording medium P by secondary transfer roller 9, and fixed on the recording medium P by fixing unit 7. Then, the recording medium P may be ejected from the main body of the apparatus. An image forming process may be performed for each of the photosensitive drums 1*a* to 1*d* while the photosensitive drums 1*a* to 1*d* are rotated counterclockwise in FIG. 4.

The recording medium P onto which the toner images are transferred may be stored in paper cassette 16 disposed in a lower section of the apparatus, and may be conveyed to secondary transfer roller 9 through paper feed roller 12*a* and a pair of registration rollers 12*b*. In some embodiments, a sheet made of dielectric resin may be used as the intermediate transfer belt 8. The intermediate transfer belt 8 may be an endless belt obtained by overlapping end portions of the sheet, or a seamless belt which has no seams. In addition, a blade-shaped belt cleaner 19 for removing the toner which remains on the surface of intermediate transfer belt 8 is disposed at a position downstream of secondary transfer roller 9.

In some embodiments, an apparatus may include multiple image forming sections Pa, Pb, Pc and Pd. Corresponding charging devices 2*a*, 2*b*, 2*c*, and 2*d* may charge the photosensitive drums 1*a* to 1*d*, respectively. Further, an exposure unit 4 may subject the photosensitive drums 1*a* to 1*d* to an exposure process based on image information. In addition, corresponding developing units 3*a*, 3*b*, 3*c*, and 3*d* may form toner images on the photosensitive drums 1*a* to 1*d*, respectively. Finally, cleaning units 5*a*, 5*b*, 5*c*, and 5*d* may be used to remove developer (toner) which remains on the photosensitive drums 1*a* to 1*d*, respectively. The charging devices, developing units, and/or cleaning units may be positioned in areas around the rotatable photosensitive drums 1*a* to 1*d* and/or below photosensitive drums 1*a* to 1*d*.

In some embodiments, a user may input a command for starting an image forming operation. Charging devices 2*a* to 2*d* may uniformly charge the surfaces of photosensitive drums 1*a* to 1*d*, respectively. Then, the surfaces of photosensitive drums 1*a* to 1*d* may be irradiated with light by exposure unit 4, so that electrostatic latent images corresponding to image signals form on photosensitive drums 1*a* to 1*d*. Developing units 3*a* to 3*d* may be filled with predetermined amounts of cyan, magenta, yellow, and black toners supplied by toner supplying devices (not shown). In some embodiments, the toners in different colors are supplied to photosensitive drums 1*a* to 1*d* by developing units 3*a* to 3*d*, respectively. The toners may electrostatically adhere to photosensitive drums 1*a* to 1*d*. Thus, toner images corresponding to the electrostatic latent images formed by the exposure process performed by the exposure unit 4 may be formed on the photosensitive drums 1*a* to 1*d*.

In some embodiments, an electric field may be applied to intermediate transfer belt 8 at a predetermined transfer voltage, and the cyan, magenta, yellow, and black toner images formed on the photosensitive drums 1*a* to 1*d* are transferred onto the intermediate transfer belt 8 by intermediate transfer rollers 6*a*, 6*b*, 6*c*, and 6*d*, respectively. The four images in different colors may be formed in a predetermined positional relationship so that a full-color image may be formed from the four images. Toner remaining on the surfaces of the photosensitive drums 1*a* to 1*d* may be removed by the cleaning units 5*a* to 5*d*, so that the next electrostatic latent images may be continuously formed.

In an embodiment, intermediate transfer belt 8 may be stretched between a conveying roller 10 and a driving roller 11. The driving roller 11 may be rotated by a driving motor (not shown), and intermediate transfer belt 8 may be rotated clockwise by the rotation of the driving roller 11. In some embodiments, when the intermediate transfer belt 8 starts to rotate clockwise, the recording medium P may be conveyed from registration rollers 12*b* to secondary transfer roller 9 positioned adjacent to intermediate transfer belt 8 at a predetermined timing. Then, a full-color image may be transferred onto the recording medium P. The recording medium P on which the full-color toner image is transferred may be conveyed to fixing unit 7.

In some embodiments, recording medium P conveyed to the fixing unit 7 may be heated and pressurized by a pair of fixing rollers 13, so that the toner image on the surface of the recording medium P is fixed. Thus, a predetermined full-color image may be formed on the recording medium P. The direction in which the recording medium P having the full-color image formed thereon is conveyed is switched between a plurality of directions by branching unit 14. In the case where the image is to be formed on only one side of the recording medium P, the recording medium P is ejected onto an ejection tray 17 by ejection rollers 15.

In some embodiments, images may be formed on both sides of recording medium. Images may be formed on both sides of the recording medium P by passing recording medium P through the fixing unit 7 and branching unit 14 toward sheet conveying path 18. Then, recording medium P is reversed and is conveyed to the secondary transfer roller 9 again. The next image that is formed on the intermediate transfer belt 8 is transferred by the secondary transfer roller 9 onto the side of recording medium P where no image is formed. Then, the recording medium P is conveyed to the fixing unit 7, where the toner image on the recording medium P is fixed. Finally, the recording medium P is ejected onto ejection tray 17.

Figure 5:
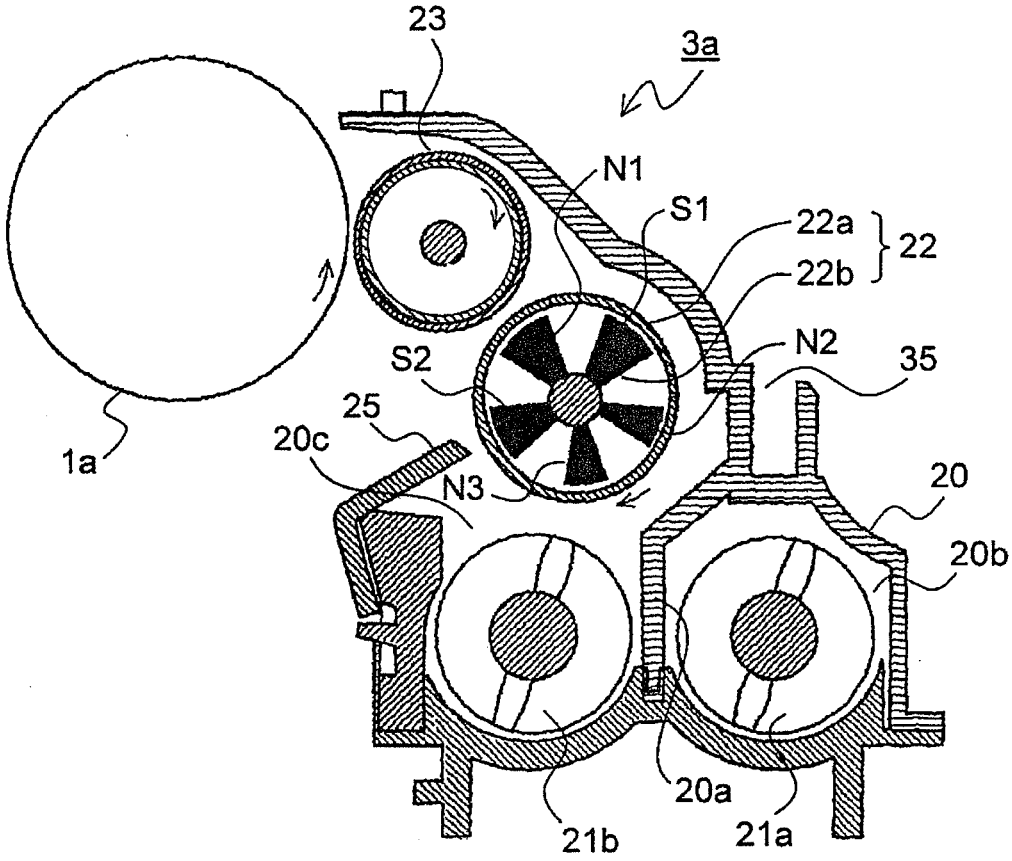
FIG. 5 is a sectional side view of the developing device according to the embodiment of the present invention.

FIG. 5 is a sectional side view illustrating the structure of the developing unit according to the present invention. Here, the developing unit 3*a* included in the image forming section P as shown in FIG. 4 will be described. The structures of the developing units 3*b* to 3*d* included in the image forming sections Pb to Pd, respectively, are similar to the structure of the developing unit 3*a*, and explanations thereof are thus omitted.

As shown in FIG. 5, the developing unit 3*a* includes developer container 20 which contains two-component developer (hereinafter referred to simply as developer). Developer container 20 is sectioned into first and second mixing chambers 20*b* and 20*c* by a partition wall 20*a*. A first mixing screw 21*a* and a second mixing screw 21*b* are rotatably disposed in the first and second mixing chambers 20*b* and 20*c*, respectively. Mixing screws 21*a* and 21*b* mix toner (positively charged toner) supplied from a toner container (not shown) with carrier to charge the toner.

Mixing screws 21*a* and 21*b* convey the developer in an axial direction thereof while mixing the developer, and the developer circulates between the first and second mixing chambers 20*b* and 20*c* through developer passages (not shown) formed in the partition wall 20*a*. In the example shown in the FIG. 5, the developer container 20 extends toward the upper left, and a developer bearing member (e.g., magnet roller) 22 is disposed above mixing screw 21*b* in the developer container 20. In addition, a developing roller 23 is disposed so as to face the developer bearing member 22 at an upper left position thereof. In some embodiments, the configurations of these parts may vary. Developing roller 23 faces the photosensitive drum 1*a* at an open side (left side in FIG. 5) of developer container 20. Developer bearing member 22 and developing roller 23 rotate clockwise in FIG. 5.

Some embodiments may include a toner sensor (not shown) disposed in the developer container 20 such that the toner sensor faces the first mixing screw 21*a*. A toner sensor may control an amount of toner provided to the developer container. For example, the toner may be supplied to the developer container 20 through toner supply port 35 from the toner container (not shown) in accordance with the toner density detected by the toner sensor.

As is shown in FIG. 5, developer bearing member 22 includes non-magnetic rotating sleeve 22*a* and a magnet member 22*b* which is disposed in the rotating sleeve 22*a* and which includes a plurality of magnet poles. Further, the magnet member 22*b* may be provided with five magnet poles including three N poles (N1 to N3 poles) and two S poles (S1 and S2 poles). In some embodiments, the magnet poles may be arranged along the rotational direction of the rotating sleeve. For example, as depicted in FIG. 5 the magnet poles are arranged along the rotational direction of the rotating sleeve 22*a* such that the S1 pole is disposed between the N1 and N2 poles and the S2 pole is disposed between the N3 and N1 poles. In alternate embodiments, the configurations of the magnet poles on the magnet member may vary. For example, the number of magnet poles used may vary. In addition, some embodiments may include an alternate arrangement of the north and south poles.

Developing roller 23 may include a non-magnetic rotating sleeve, and faces rotating sleeve 22*a* of developer bearing member 22 such that a predetermined gap is provided therebetween. As shown in FIG. 5, developing roller 23 faces the N1 pole with a predetermined gap therebetween.

In addition, some embodiments may include developer regulating member 25 attached to the developer container 20 such that the developer regulating member 25 extends in the longitudinal direction (an axial direction) of the rotating sleeve 22*a* (direction perpendicular to the page in FIG. 5). Developer regulating member 25 is positioned upstream of the position at which developing roller 23 and developer bearing member 22 face each other in the rotational direction of rotating sleeve 22*a* (clockwise direction in FIG. 5). A small space (gap) may be provided between an end portion of the developer regulating member 25 and the surface of the rotating sleeve 22*a*.

In an embodiment, a predetermined direct-current voltage and a predetermined alternating-current voltage may be applied to the developer bearing member 22 and the developing roller 23. As described above, the first mixing screw 21*a* and the second mixing screw 21*b* cause the developer to circulate in the developer container 20 while mixing the developer to charge the toner, and the developer is conveyed to the developer bearing member 22 by the second mixing screw 21*b*. In some embodiments, a magnetic brush (not shown) may be formed on the developer bearing member 22. The layer thickness of the magnetic brush on the developer bearing member 22 may be regulated by the developer regulating member 25. As a result, a thin toner layer may be transferred from the developer bearing member to the developing roller. This transfer may occur in accordance with the potential difference between the developer bearing member developer bearing member 22 and the developing roller 23. For example, the potential difference between the magnetic field between the N1 pole and the developing roller 23 may allow the transfer from the developer bearing member to the developing roller. Then, the thin toner layer formed on the developing roller 23 may be transferred to the photosensitive drum 1*a* as an electrostatic latent image.

An embodiment may include a method for regulating an amount of developer provided on the developer bearing member 22. The method will be described in detail with reference to FIG. 5. As shown in FIG. 5, developer regulating member 25 faces the S2 pole. Therefore, if developer regulating member 25 is made of a magnetic body, an attractive magnetic field may be generated between the end of the developer regulating member 25 and the rotating sleeve 22*a*. A magnetic body may be formed from any material that responds to a magnetic field including, but not limited to magnetic stainless steel.

Due to this magnetic field, the developer may be formed into a brush-like shape which extends between developer regulating member 25 and rotating sleeve 22*a*. Thus, a magnetic brush may be formed. Then, when the rotating sleeve 22*a* rotates clockwise and the magnetic brush reaches a position at which the rotating sleeve 22*a* faces the developing roller 23, the magnetic brush comes into contact with the surface of the developing roller 23 at a position between the N1 pole and the developing roller 23. In some embodiments, due to the electric field applied between the rollers, the magnetic brush forms a thin toner layer on the surface of the developing roller 23.

When the rotating sleeve 22*a* further rotates, a repulsive magnetic field is applied by the N2 pole and the N3 pole. Thus, the developer is removed from rotating sleeve 22*a* in developer container 20. The developer is mixed and conveyed by the second mixing screw 21*b*, and is attracted to the rotating sleeve 22*a* again by the magnetic field generated by the N3 pole, so that the magnetic brush is formed. Thus, an amount of developer provided on developer bearing member 22 may be controlled not only by the gap between the developer regulating member 25 and the rotating sleeve 22*a* but also by the magnetic field generated therebetween.

Figure 6:
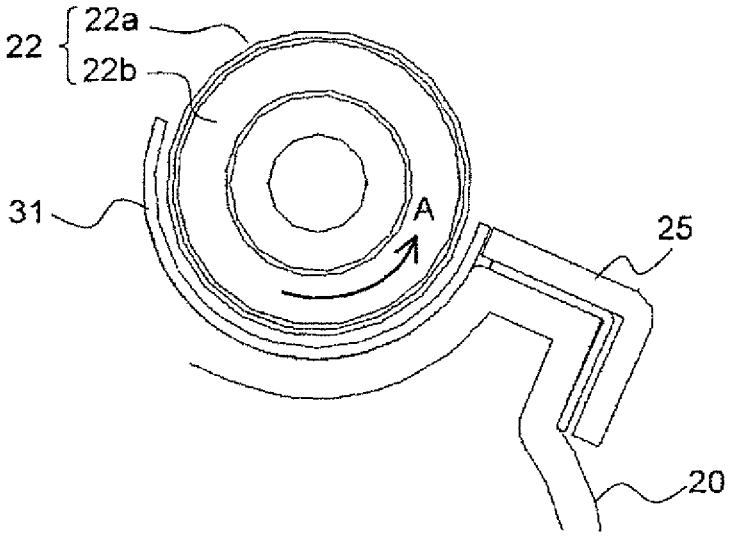
FIG. 6 is a sectional view of a developer bearing member and a developer regulating member included in the developing device according to the embodiment of the present invention at one end of the developing device in the longitudinal direction thereof.
Figure 7:
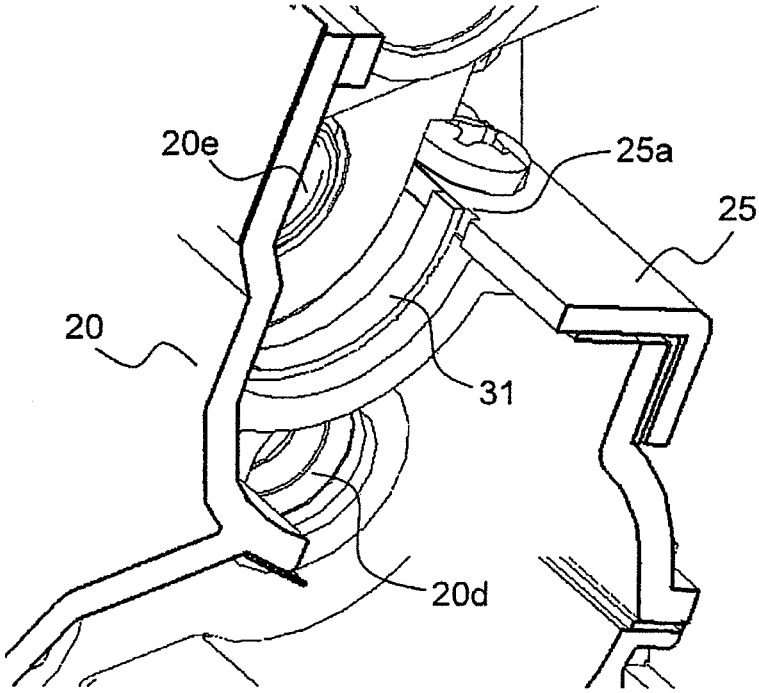
FIG. 7 is a sectional perspective view of a section around an end of the developer regulating member included in the developing device according to the embodiment of the present invention viewed from the inside of the developing device.

FIG. 6 is a sectional view of a developer bearing member and a developer regulating member 25 included in the developing device at one end of the developing device in the longitudinal direction thereof. FIG. 7 is a sectional perspective view of a section around an end of the developer regulating member viewed from the inside of the developing device. In FIGS. 6 and 7, the developing device is viewed in a direction opposite to the direction in which the developing device is viewed in FIG. 5. Therefore, in FIGS. 6 and 7, the developer regulating member 25 is on the right side of the developer bearing member 22. In addition, for convenience of explanation, the second mixing screw 21*b* and the developer bearing member 22 are not shown in FIG. 7. The developer bearing member 22 and the developer regulating member 25 have similar sealing structures at either end thereof. Therefore, only the sealing structure at one end thereof will be described herein.

Figure 8:
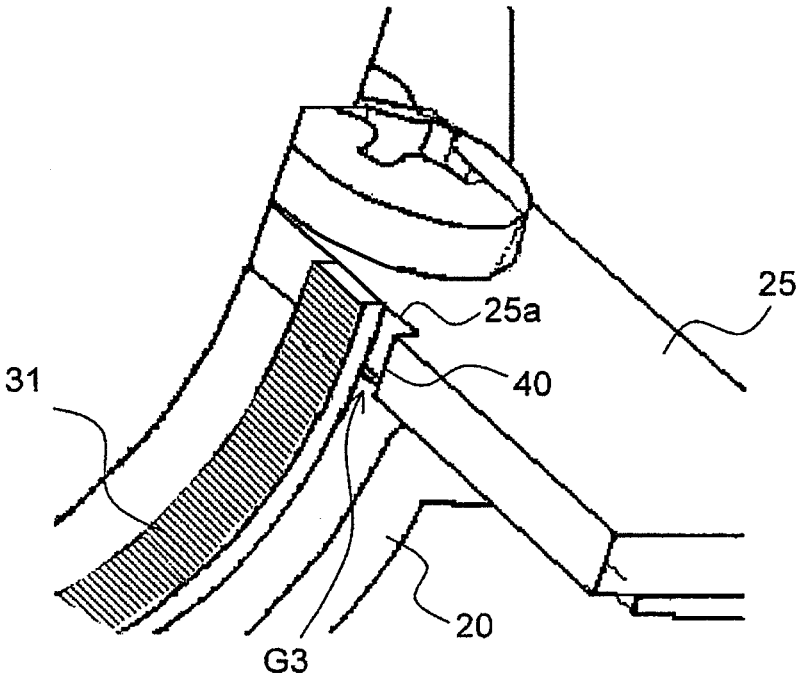
FIG. 8 is an enlarged view of a section around an end of a magnetic sealing member shown in FIG. 7.
Figure 9:
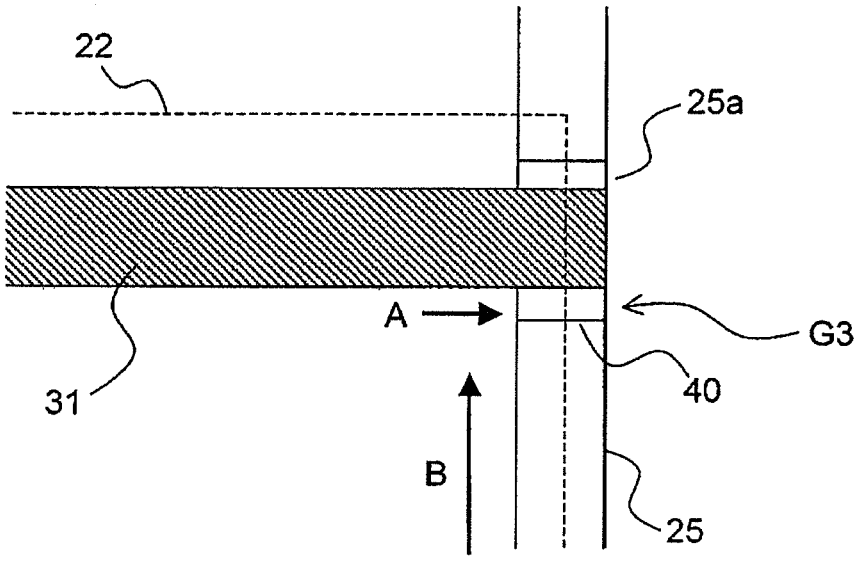
FIG. 9 is a plan view of the structure around a cut portion in the developing device according to the embodiment of the present invention, viewed from the magnetic sealing member.

As shown in FIGS. 6 and 7, bearing hole 20*d* for supporting second mixing screw 21*b* in a rotatable manner and bearing hole 20*e* for supporting developer bearing member 22 in a rotatable manner are formed in developer container 20. Developer container 20 has an arc-shaped portion on an inner surface thereof, and the arc-shaped portion has an arc shape that is concentric with bearing hole 20*e*. A band-shaped magnetic sealing member 31 is provided on the arc-shaped portion of developer container 20. The magnetic sealing member 31 may extend along the outer peripheral surface of rotating sleeve 22*a* of developer bearing member 22 with a predetermined gap provided between magnetic sealing member 31 and rotating sleeve 22*a*. In some embodiments, an end face of the developer regulating member may include one or more cut portions. For example, as shown in FIGS. 7-8 cut portion 25*a* is formed in an end face of the developer regulating member 25, which faces the developer bearing member 22. FIG. 9 depicts magnetic sealing member 31 extending to come in contact with the cut portion 25*a* from the upstream side in the rotational direction of the developer bearing member 22 (direction shown by the arrow A).

In some embodiments, this structure described in FIGS. 7-9 may allow the sealing effect of the magnetic sealing member 31 to be obtained at a position downstream of the developer regulating member 25. Thus, leakage of the developer through an area where the developer regulating member 25 and the magnetic sealing member 31 are near each other may be inhibited. Some embodiments may include an auxiliary sealing member.

In some embodiments, use of the structure defined in FIGS. 7 and 9 may render use of an auxiliary sealing member unnecessary. Therefore, a number of components and the number of manufacturing steps may be reduced. In the process of attaching the developer regulating member 25, the developer regulating member 25 may be positioned such that the magnetic sealing member 31 passes through the cut portion 25*a*. Thus, a clearance may be provided between the developer bearing member 22 and the magnetic sealing member 31, and the magnetic sealing member 31 may be arranged so as to extend to a position downstream of the developer regulating member 25.

Magnetic sealing members may be from various materials including, but not limited to a permanent magnet, a ferromagnetic material, such as iron, nickel, cobalt, and alloys thereof, and/or any other material capable of being magnetized. In some embodiments, magnetic sealing member 31 may be comprised of, for example, a permanent magnet. In an embodiment, a magnetic sealing member may not be a magnet. In order to obtain sufficient sealing effect prevented from the leakage of the developer on the magnetic brush, where the magnetic sealing member 31 is not a magnet, the magnet member 22*b* may extend to the end of the developer bearing member 22 so that the magnetic sealing member 31 is positioned near the magnet member 22*b*.

Figure 10:
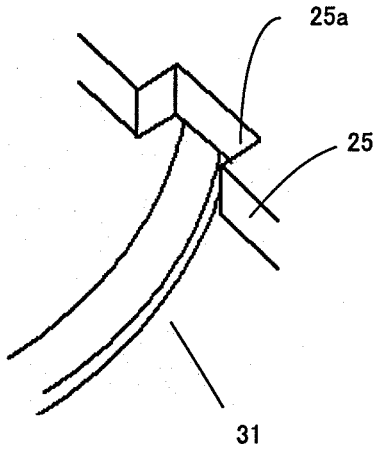
FIG. 10 is an enlarged view of a section around an end of a magnetic sealing member.
Figure 11:
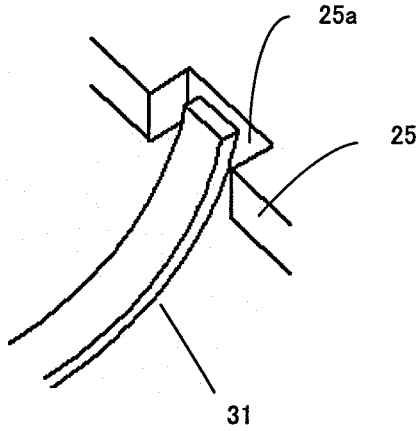
FIG. 11 is an enlarged view of a section around an end of a magnetic sealing member.
Figure 12:
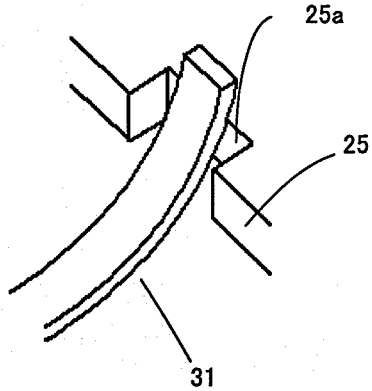
FIG. 12 is an enlarged view of a section around an end of a magnetic sealing member.

Magnetic sealing members may be positioned such that an end portion of the magnetic sealing member is positioned proximate the cut portion of developing regulating member. As shown in FIG. 10, magnetic sealing member 31 may be positioned such that an end of the magnetic sealing member contacts cut portion 25*a* of developing regulating member 25. In an embodiment depicted in FIG. 11 magnetic sealing member 31 may be positioned such that an end portion of the magnetic sealing member extends into cut portion 25*a* of developing regulating member 25. Further, some embodiments as shown in FIG. 12 may include magnetic sealing member 31 which extends through cut portion 25*a* extending beyond an upper surface of developing regulating member 25.

In an embodiment, an end of the magnetic sealing member may be positioned proximate a cut portion of developer regulating member. Additionally, the magnetic sealing member may extend to come in contact with the cut portion from an upstream side in a rotational direction of the developer bearing member. For example, an undersurface of the magnetic sealing member may be in contact with an upper surface of the cut portion and/or extend through the cut portion from an upstream side in a rotational direction of the developer bearing member.

FIG. 8 depicts an enlarged view of a section around the end the magnetic sealing member shown in FIG. 7. As shown in FIG. 8, the width of the cut portion 25*a* may be larger than that of the magnetic sealing member 31, and a gap G3 may be formed between the magnetic sealing member 31 and an inner side edge 40 of the cut portion 25*a*. The position of gap G3 may be determined in consideration of the attachment position of the magnetic sealing member 31, the dimensions of the developer regulating member 25, the position at which the cut portion 25*a* is formed, etc. This may inhibit the magnetic sealing member 31 from interfering with the coupling of the developer regulating member 25.

As shown in FIG. 9, the direction in which the developer moves from the central area of the developer bearing member 22 to the end thereof (direction shown by the arrow B) and the direction in which the magnetic sealing member extends (direction shown by the arrow A) are perpendicular to each other. Therefore, the developer which moves in the direction shown by the arrow B from the central area of the developer bearing member 22 to the end thereof is blocked by the magnetic sealing member 31, and then moves in the direction shown by the arrow A. Thus, magnetic sealing member 31 reduces the pressure of the developer which moves toward gap G3.

In some embodiments, magnetic sealing member 31 may overlap cut portion 25*a*. Gap G3 may be filled with the magnetic brush formed between the magnetic sealing member 31 and the developer bearing member 22. Thus, the sealing effect of the magnetic sealing member 31 may occur in the gap G3, and therefore the developer may be inhibited from leaking through the gap G3. In an embodiment where the developer regulating member 25 is made of a magnetic body and the magnetic sealing member 31 is made of a magnet, a magnetic field between the developer regulating member 25 and the magnetic sealing member 31 may be generated in gap G3. Therefore, the leakage of the developer may be inhibited. Proper dimensioning of gap G3 may affect a seal formed using the magnetic sealing member.

Various modifications of the above-described embodiments are possible within the scope of the present invention. For example, the developing device is not limited to the developing device shown in FIGS. 4-12. Embodiments may include various kinds of developing devices using single-component magnetic developer or two-component developer including a toner component and magnetic carrier.

The sealing structure described in the above-described embodiment is provided in the developing device including the developer bearing member 22 and the developing roller 23, and is disposed at each end of the developer bearing member 22 and the developer regulating member 25 in the longitudinal direction thereof. In an embodiment, the sealing structure may be provided in a developing device in which the developer bearing member 22 and the photosensitive drum 1 are disposed so as to face each other. Thus, a sealing structure may be used in embodiments without the developing roller.

An embodiment may include a developing device having a housing which houses magnetic developer; a developer bearing member which is rotatably supported by the housing and which holds the developer with a magnet member disposed in the developer bearing member; a developer regulating member which extends along a longitudinal direction of the developer bearing member, the developer regulating member having a cut portion at each end thereof in a surface which faces the developer bearing member and regulating an amount of the developer held on the developer bearing member; and a magnetic sealing member which extends along an outer peripheral surface of the developer bearing member at each end of the developer bearing member in the longitudinal direction thereof and extends to the cut portion from an upstream side in a rotational direction of the developer bearing member.

In addition, some embodiments of the developer regulating member may include a magnetic body.

An embodiment provides an image forming apparatus having the developing device described herein. Having thus described in detail preferred embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A developing device comprising:

a housing configured to store magnetic developer;

a developer bearing member supported by the housing comprising a magnet member disposed in the developer bearing member, wherein the developer bearing member rotates within the housing;

a developer regulating member positioned substantially parallel to the developer bearing member and being configured to regulate an amount of the developer held on the developer bearing member, the developer regulating member having one or more recess-shaped cut portions each comprising a first side-wall surface portion and a second side-wall surface portion that each extends upwardly from a respective end portion of a lower surface portion of the recess-shaped cut portion such that the recess-shaped cut portion includes an opening partially bounded by the lower surface portion and the first and second side-wall surface portions; and one or more magnetic sealing members which extend along an outer peripheral surface of the developer bearing member positioned proximate an end portion of the developer bearing member wherein a portion of the magnetic sealing member is positioned substantially within the opening and between the first and second side-wall surface portions of the recess-shaped cut portion of the developer regulating member, a surface of the magnetic sealing member faces the developer bearing member and an opposite surface of the magnetic sealing member faces the lower surface portion of the cut portion, and a width of the magnetic sealing member is smaller than a width of the cut portion.

2. The developing device according to claim 1, wherein the one or more magnetic sealing members comprise two magnetic sealing members positioned at a first end portion and a second end portion of the developer bearing member.

3. The developing device according to claim 1, wherein the one or more cut portions are positioned to substantially face the developer bearing member.

4. The developing device according to claim 1, wherein a primary direction in which the developer is moved by the developer bearing member and a direction in which the magnetic sealing member extends are perpendicular to each other.

5. The developing device according to claim 1, wherein the developer regulating member includes a magnetic body.

6. The developing device according to claim 1, wherein a surface of the magnetic sealing member is positioned proximate a surface of the cut portion from an upstream side in the rotational direction of the developer bearing member.

7. The developing device according to claim 1, wherein the magnetic sealing member extends through the cut portion from an upstream side in a rotational direction of the developer bearing member.

8. The developing device according to claim 1, wherein the magnetic sealing member extends through the cut portion from an upstream side to extend beyond a downstream surface of the developer regulating member.

9. An image forming apparatus comprising:

an image bearing member;

a charging device which charges the image bearing member uniformly;

an exposure unit which exposes the image bearing member based on image information;

a fixing unit which fixes a toner on a recording medium; and a developing device comprising:

a housing comprising magnetic developer;

a developer bearing member which is rotatably supported by the housing and is configured to hold the developer with a magnet member disposed in the developer bearing member;

a developer regulating member which extends along a longitudinal direction of the developer bearing member, having a recessed-shaped cut portion at each end portion of the developer regulating member in a surface facing the developer bearing member, each recess-shaped cut portion comprising a first side-wall surface portion and a second side-wall surface portion that each extends upwardly toward the developer bearing member from a respective end portion of a lower surface portion of the recess-shaped cut portion such that the recess-shaped cut portion includes an opening partially bounded by the lower surface portion and the first and second side-wall surface portions; and a magnetic sealing member which extends along an outer peripheral surface of the developer bearing member at each end portion of the developer bearing member in the longitudinal direction thereof, and extends to come in contact with the recess-shaped cut portion from an upstream side in a rotational direction of the developer bearing member, such that a surface of the magnetic sealing member faces the developer bearing member and an opposite surface of the magnetic sealing member faces the lower surface portion of the recess-shaped cut portion, and wherein a width of the magnetic sealing member is smaller than a width of the cut portion.

10. An image forming apparatus according to claim 9, wherein the developer regulating member includes a magnetic body.

11. An image forming apparatus according to claim 9, wherein the developer regulating member is configured to regulate an amount of the developer held on the developer bearing member.

12. An image forming apparatus according to claim 9, wherein a undersurface of the magnetic sealing member contacts with a upper surface of the cut portion from an upstream side in the rotational direction of the developer bearing member.

13. An image forming apparatus according to claim 9, wherein the magnetic sealing member extends through the cut portion from an upstream side in a rotational direction of the developer bearing member.

14. A method of inhibiting leakage of the developer during a printing process, comprising:

providing one or more magnetic sealing members at an end of a developing device having one or more recess-shaped cut portions each comprising a first side-wall surface portion and a second side-wall surface portion that each extends upwardly from a respective end portion of a lower surface portion of the recess-shaped cut portion such that the recess-shaped cut portion includes an opening partially bounded by the lower surface portion and the first and second side-wall surface portions, the magnetic sealing members extending along an outer peripheral surface of a developer bearing member positioned proximate an end portion of the developer bearing member, a portion of the magnetic sealing member being positioned substantially within the opening and between the first and second side-wall surface portions of the recessed-shaped cut portion of the developer regulating member, and a surface of the magnetic sealing member facing the developer bearing member and an opposite surface of the magnetic sealing member facing the lower surface portion of the cut portion;

providing a magnet member in a developer bearing member proximate the magnetic sealing member;

providing developer to a surface of the developer bearing member; and allowing a magnetic field to form between the magnetic sealing member and the magnet member such that a magnetic field inhibits movement of the developer beyond a plane corresponding to the edge of the magnetic sealing member.

15. The method of claim 14 wherein the one or more magnetic sealing members are positioned within one or more of the cut portions of the developer regulating member.

16. The method of claim 14 wherein the one or more magnetic sealing members comprise two magnetic sealing members positioned at a first end and a second end of the developer bearing member.

* * * * *